US007163069B2

(12) United States Patent
Bauer et al.

(10) Patent No.: US 7,163,069 B2
(45) Date of Patent: Jan. 16, 2007

(54) TELESCOPABLE BORING ROD MECHANISM

(75) Inventors: Sebastian Bauer, München (DE); Leonhard Weixler, Thierhaupten (DE)

(73) Assignee: Bauer Maschinen GmbH, Wittelsbacherstrasse (DE)

( * ) Notice: Subject to any disclaimer, the term of this patent is extended or adjusted under 35 U.S.C. 154(b) by 152 days.

(21) Appl. No.: 10/773,449

(22) Filed: Feb. 9, 2004

(65) Prior Publication Data

US 2004/0216928 A1 Nov. 4, 2004

(30) Foreign Application Priority Data

Feb. 7, 2003 (DE) ..... 203 01 946 U

(51) Int. Cl.
*E21B 17/00* (2006.01)
*E21B 17/07* (2006.01)

(52) U.S. Cl. ..... 175/320; 175/321

(58) Field of Classification Search ..... 175/320, 175/321; 166/237, 242.1, 242.7; 464/18, 464/162, 179, 183
See application file for complete search history.

(56) References Cited

U.S. PATENT DOCUMENTS

| | | | | |
|---|---|---|---|---|
| 2,624,549 | A * | 1/1953 | Wallace | 464/18 |
| 3,306,078 | A * | 2/1967 | Hughes | 464/20 |
| 3,501,173 | A * | 3/1970 | Linder et al. | 285/114 |
| 3,517,760 | A | 6/1970 | Kehrberger | |
| 4,054,040 | A * | 10/1977 | Medders | 464/18 |
| 4,256,179 | A * | 3/1981 | Shillander | 166/237 |
| 4,463,815 | A * | 8/1984 | Jurgens et al. | 175/302 |
| 5,787,981 | A * | 8/1998 | Taylor | 166/237 |
| 5,964,307 | A * | 10/1999 | Wenzel | 175/321 |
| 6,710,600 | B1 * | 3/2004 | Kopecki et al. | 324/338 |

FOREIGN PATENT DOCUMENTS

| | | |
|---|---|---|
| DE | 32 41 797 | 11/1982 |
| DE | 87 14 200 | 3/1988 |
| EP | 03 35 059 | 10/1989 |
| EP | 03 76 239 | 7/1990 |
| GB | 2 108 900 | 5/1983 |

* cited by examiner

*Primary Examiner*—Kenneth Thompson
(74) *Attorney, Agent, or Firm*—Jacobson Holman PLLC

(57) ABSTRACT

The invention relates to a telescopable boring rod mechanism with at least two mutually displaceable Kelly rods, which are equipped with means for transmitting a torque to the adjacent Kelly rod. At least one of the Kelly rods is constructed from at least two rod segments, which are made from a different material.

10 Claims, 1 Drawing Sheet

TELESCOPABLE BORING ROD MECHANISM

BACKGROUND OF THE INVENTION

1. Field of the Invention

The invention relates to a telescopable boring rod mechanism with at least two mutually displaceable Kelly rods, which have means for transmitting a torque to the adjacent Kelly rod.

2. Related Art

Such telescopable boring rod mechanisms are required for the so-called Kelly boring method, which is one of the most flexible procedures e.g. for the production of foundation piles for buildings. The torque of the boring implement is transmitted from a turning gear, which can be moved up and down on a mast, to a boring rod mechanism, the so-called Kelly rod mechanism. The Kelly rod mechanism comprises several telescoped tubular Kelly rods, whereof the innermost rod is suspended on a cable of the implement and can therefore be moved up and down, which brings about the telescoping of the Kelly rod mechanism. The boring tool is fixed to the bottom of the innermost Kelly rod. Through more or less vertical fillets on the outside of each individual Kelly rod and corresponding vertical driving slots on the adjacent Kelly rod, in accordance with a shaft-collar connection or joint, the torque and therefore the rotary movement is transmitted from one Kelly rod to the other. Thus, the rotary movement is transmitted from the turning gear to the boring tool in the borehole.

Telescoping takes place in the following way. Initially, when the Kelly rod mechanism is completely outside the borehole, all the Kelly rods on their lower stop are located on the bottom Kelly rod, also known as the inner Kelly. The completely retracted Kelly rod mechanism is consequently suspended by means of the inner Kelly on the Kelly cable. If the Kelly rod mechanism is then lowered into the hole, at a specific time an upper stop of the Kelly rod mechanism strikes against a Kelly driver of the turning gear and rests there. During further lowering the remaining Kelly rods move downwards until the next inner Kelly rod "sticks" with its upper stop on the lower end of the outermost Kelly rod. This can be continued until the Kelly rod mechanism has been completely extended. Such Kelly rod mechanisms are e.g. known from EP 376 239 A or U.S. Pat. No. 3,517,760.

Torque can be transmitted in any extension state of the Kelly rod. The Kelly rods on the lower stop either rest on the next inner Kelly rod or they hang with their upper stop on the next outer rod. With all the Kelly rods the torque is transmitted at the upper or lower end. Only in the case of a single Kelly rod, the outermost of those resting on the innermost rod, does the Kelly driver of the next outer rod engage between the upper and lower end in the Kelly fillets and transmits torque there.

Besides the transmission of the rotary movement in the case of so-called lockable Kelly rod mechanisms, a vertical force is transmitted from the slide on which the turning gear moves up and down on the mast, via the Kelly rod mechanism to the boring tool, in order to produce the contact pressure necessary for removing soil. For this purpose locking pockets are fitted to all the Kelly rods at specific spacings.

EP 335 059 A discloses a Kelly rod mechanism with toothed driving fillets, which permit an axial force transfer or transmission in a plurality of positions corresponding to the spacing of the tooth system.

The material used for the Kelly rod mechanism is steel in suitable alloys in order to ensure the necessary strength in operation. The torque to be transmitted decides the diameter and thickness of the Kelly rods.

Particularly in the case of greater boring depths for which correspondingly long Kelly rod mechanisms are necessary, there can be a relatively high Kelly rod mechanism weight. This is not only decisive for the design of the necessary winches and drives, but also for the statics of the mast on which the boring rod mechanism is suspended. Since, as a result of design, the boring axis must be upstream of the crawlers of the boring implement, a heavy Kelly rod mechanism means a correspondingly high tilting moment of the implement. It must be correspondingly highly ballasted for adequate stability, which in turn requires a larger and more stable crawler vehicle. This leads to higher costs and restrictions during the transportation and positioning of the boring implement.

SUMMARY OF THE INVENTION

The object of the invention is to provide a telescopable boring rod mechanism, which allows an efficient, inexpensive boring operation.

This object is achieved by a telescopable boring rod mechanism having at least two mutually displaceable Kelly rods, which are equipped with means for transmitting a torque to the adjacent Kelly rod, wherein at least one of the Kelly rods is constructed from at least two rod segments, which are made from a different material.

The invention is characterized in that at least one of the Kelly rods is constructed from at least two rod segments, which are made from different materials. A fundamental idea of the invention is based on the finding that on a Kelly rod there are areas with different functions and loads. According to the invention areas with a high load and contact pressure can be made from a correspondingly high strength material, whereas areas with a lower load and contact pressure can be made from a simpler material. This permits a Kelly rod mechanism construction in accordance with the particular function and requirement, which permits economies with respect to high strength and therefore expensive material.

Particularly in the case of longer drilling rod mechanisms for greater boring depths the invention leads to a considerable weight saving due to the fact that the rod segment material is a lightweight construction material, particularly a carbon fibre-reinforced plastic. It is also possible to use other lightweight construction materials such as light metals. In an arrangement assembled from tubular or rod-shaped segments, carbon fibre-reinforced plastic permits an adequately high axial force and torque transmission.

In areas with a high contact pressure, such as occur where the torques and forces are transmitted from one Kelly rod to the adjacent rod, use can be made of a corresponding high strength, heavy material, such as steel in a corresponding alloy.

According to the invention the means for transmitting the force or torque is constructed on a rod segment made from a steel material. Preferably the upper and/or lower end of the Kelly rod is constructed on a rod segment made from a steel material. For a force or torque transmission in one or more intermediate sections, further transmission devices can be provided. The other rod segments located between the steel material rod segments can be made from the lightweight construction material.

As a result of the function the individual Kelly rods have a tubular construction and the inner Kelly can also be a solid rod. The individual Kelly rods can have a random cross-section. However, according to the invention, a particularly favourable ratio between the weight and torsional stiffness is obtained in that the rod segments are constructed in tubular manner with an annular cross-section. More particularly for lightweight segments made from a carbon fibre-reinforced plastic, an annular cross-section brings about a particularly high torsional stiffness.

Apart from the possibility of torque transmission, the boring rod mechanism according to the invention is further developed in such a way that the rod segments have means for transmitting an axial force to the adjacent rod segments. Preferably the means for transmitting an axial force are constructed together with the means for transmitting a torque, e.g. in the form of so-called locking pockets.

A particularly robust boring rod mechanism is obtained, according to the invention, in that the means for transmitting a torque and/or the means for transmitting an axial force have interlocking members.

Preferably the interlocking members comprise fillets or beads, locking pockets and/or driving slots. Thus, a torque and force transmission such as occurs with the known shaft-collar joints occurs between the individual Kelly rods.

In the case of the rod segments made from the lightweight construction material there is no direct force and torque transmission from an adjacent Kelly rod, because this leads to particularly high contact pressures. Thus, on their outside such rod segments can be given a smooth surface in the form of simple pipes. However, in order to achieve a reliable telescopability, according to the invention axially directed guide rails are provided on the lightweight construction material rod segment. As these are not intended for direct force transmission, the guide rails can be subsequently fixed by appropriate connecting devices to the rod segments.

According to a further development of the invention the outer Kelly rod is made entirely from metal. Preferably the outer Kelly rod is provided with a plurality of means for transmitting a torque and/or an axial force and which are located at different heights. Over its entire surface the outer Kelly rod can permit a torque transmission. In this way, for the other Kelly rods it is possible to limit to two the axial force and torque transmission means. Then on lowering the Kelly rod mechanism the outermost Kelly rod must initially be locked at the corresponding height relative to the rotary drive. This can take place passively by a bayonet catch-like mechanism or actively by a mechanism emanating from the rotary drive. Then the Kelly rod mechanism is lowered again in such a way that all the other Kelly rods are either completely or not extended. In addition, through the complete extension of the outer Kelly rod, there is also a very good passive protection of the retracted boring rod mechanism.

BRIEF DESCRIPTION OF THE DRAWINGS

The invention is described in greater detail hereinafter relative to a preferred embodiment and the attached diagrammatic drawings, wherein show.

DETAILED DESCRIPTION OF THE PREFERRED EMBODIMENTS

Figure 1:
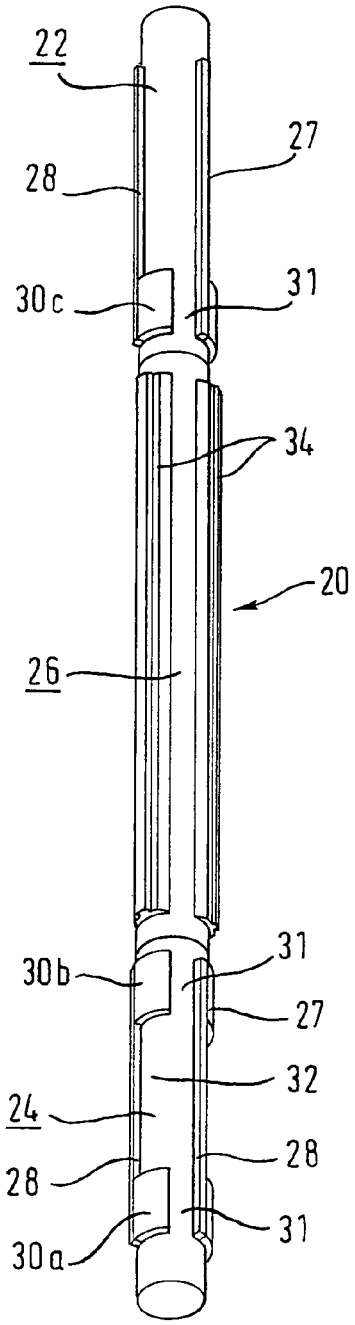
FIG. 1 A perspective representation of an inner Kelly rod according to the invention.
Figure 2:
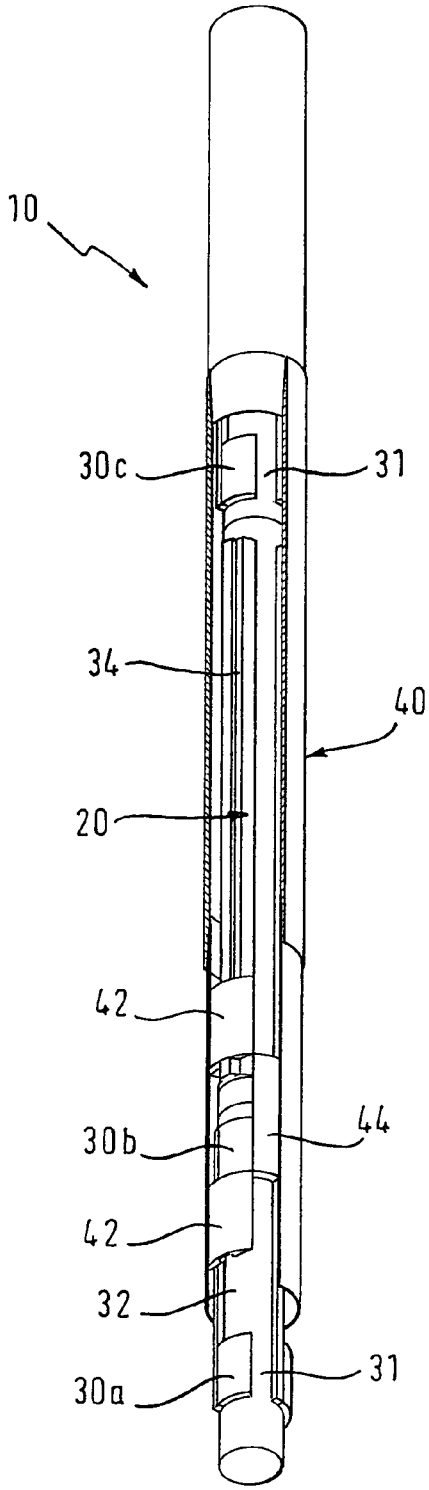
FIG. 2 A perspective, part sectional representation of an inventive drilling rod mechanism with the Kelly rod of FIG. 1.

The embodiment of the invention diagrammatically shown in FIGS. 1 and 2 is a simple, telescopable boring rod mechanism 10 with a first, inner Kelly rod 20 and a second, outer Kelly rod 40. The inner Kelly rod 20 is constructed from three tubular segments, an upper segment 22, a lower segment 24 and an intermediate, central segment 26. In both the upper segment 22 and lower segment 24 are provided several circumferentially distributed axial force and torque transmission means 27. For this purpose the lower segment 24 has axially directed beads 28, which are in each case bounded on their two ends and on one side by axial stops 30*a*, 30*b*. Through the bead 28 and the two adjacent, mutually spaced axial stops 30*a*, 30*b* is formed a locking pocket 32 in which can be received a driver of the adjacent Kelly rod.

Circumferentially the two axial stops 30*a*, 30*b* are spaced in a clearly defined manner from the next bead 28 and a recess 31 is formed for the axial passage of the driver.

On the upper segment 22 is correspondingly constructed a force and torque transmission means 27, but there is only a single axial stop 30*c* at the lower end of the bead 28. The upper segment 22 and the lower segment 24 with the beads 28 and axial stops 30 constructed thereon are made from a steel material, which has the necessary strength, particularly for the bead 28 and axial stops 30 during force transmission between the individual Kelly rods 20, 40.

In order to save weight, the central segment 26 is made from a lightweight construction material, particularly a carbon fibre-reinforced plastic. The tubular, central segment 26 is firmly connected by suitable connecting devices at its two free ends to the upper segment 22 or lower segment 24. To the outside of the central segment 26 can be fixed axially directed guide rails 34, but these are used for guided telescoping and not for torque transmission.

For this purpose, on the inside of the outer Kelly rod 40 are provided correspondingly positioned axial guidance elements 42 with guide slots made therein and in which engage the guide rails 34. Moreover, on the inside of the outer Kelly rod 40 at least one driver 44 for torque transmission purposes is provided. Through the lowering or raising of the inner Kelly rod 20 by means of a not shown Kelly cable, the driver 44 passes through the recess 31 into the area of the locking pocket 22 on the lower segment 24 of the inner Kelly rod 20. Through contact with the bead 28 or the stop faces of the lower axial stop 30*a* or the upper axial stop 30*b* a torque or axial force transmission can take place between the two adjacent Kelly rods 20, 40. A not shown tool mounting or receptacle is provided on the inner Kelly rod 20. The inventive Kelly rod mechanism is suitable not only for receiving boring and cutting tools, but also for other soil working tools such as grippers.

The invention claimed is:

1. Telescopable boring rod mechanism with at least two mutually displaceable Kelly rods, which are equipped with means for transmitting a torque to an adjacent Kelly rod, wherein at least one of the Kelly rods is constructed from at least two rod segments, which are made from a different material, wherein one rod segment is made from a steel material and the other rod segment is made from a lightweight construction material, the rod segment made from the lightweight construction material being firmly connected to the rod segment made from the steel material and having a sufficient torsional stiffness for permitting torque transmission, wherein the lightweight construction material of the rod segment is carbon fibre-reinforced plastic.

2. Telescopable boring rod mechanism according to claim 1, wherein at least one of an upper end and a lower end of the Kelly rod is constructed on a rod segment made from a steel material.

3. Telescopable boring rod mechanism according to claim 1, wherein the rod segments are constructed in tubular manner with an annular cross-section.

4. Telescopable boring rod mechanism according to claim 1, wherein one of the Kelly rods is an outer Kelly rod, and the outer Kelly rod is made entirely of metal.

5. Telescopable boring rod mechanism according to claim 1, wherein the Kelly rod comprises an upper end rod segment and a lower end rod segment both made from a steel material and an intermediate rod segment made from the lightweight construction material, the intermediate rod segment being firmly connected to the upper end rod segment and the lower end rod segment and having a sufficient torsional stiffness for permitting torque transmission.

6. Telescopable boring rod mechanism according to claim 1, wherein the rod segments have means for transmitting an axial force to adjacent Kelly rods.

7. Telescopable boring rod mechanism according to claim 6, wherein at least one of the torque transmission means and the axial force transmission means have interlocking members.

8. Telescopable boring rod mechanism according to claim 7, wherein the interlocking members comprise at least one of beads, locking pockets and driving slots.

9. Telescopable boring rod mechanism with at least two mutually displaceable Kelly rods, which are equipped with means for transmitting a torque to an adjacent Kelly rod, wherein at least one of the Kelly rods is constructed from at least two rod segments, which are made from a different material, wherein one rod segment is made from a steel material and the other rod segment is made from a lightweight construction material, the rod segment made from the lightweight construction material being firmly connected to the rod segment made from the steel material and having a sufficient torsional stiffness for permitting torque transmission, wherein the means for transmitting a torque are constructed on one rod segment, which is made from a steel material.

10. Telescopable boring rod mechanism with at least two mutually displaceable Kelly rods, which are equipped with means for transmitting a torque to an adjacent Kelly rod, wherein at least one of the Kelly rods is constructed from at least two rod segments, which are made from a different material, wherein one rod segment is made from a steel material and the other rod segment is made from a lightweight construction material, the rod segment made from the lightweight construction material being firmly connected to the rod segment made from the steel material and having a sufficient torsional stiffness for permitting torque transmission, wherein axially directed guide rails are provided on the lightweight construction material rod segment.

* * * * *